US008763781B2

(12) United States Patent
Heinemann et al.

(10) Patent No.: US 8,763,781 B2
(45) Date of Patent: Jul. 1, 2014

(54) ESCALATOR OR MOVING WALKWAY WITH A SOFFIT PLATE

(75) Inventors: Gerd Heinemann, Bad Harzburg (DE); Michael Matheisl, Vosendorf (AT); Stephan Hauer, Vienna (AT); Wolfgang Klein, Neusied/See (AT); Wolfgang Neszmerak, Vienna (AT)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 13/598,862

(22) Filed: Aug. 30, 2012

(65) Prior Publication Data

US 2013/0228414 A1 Sep. 5, 2013

(30) Foreign Application Priority Data

Aug. 30, 2011 (EP) ..... 11179240

(51) Int. Cl.
*B26B 23/00* (2006.01)

(52) U.S. Cl.
USPC ..... 198/321; 198/325; 198/333

(58) Field of Classification Search
USPC ..... 198/321–338
See application file for complete search history.

(56) References Cited

U.S. PATENT DOCUMENTS

| | | | | | |
|---|---|---|---|---|---|
| 4,175,653 | A | * | 11/1979 | Kubota et al. | 198/332 |
| 4,535,880 | A | * | 8/1985 | Boltrek | 198/330 |
| 4,627,527 | A | * | 12/1986 | Saito | 198/335 |
| 4,842,122 | A | * | 6/1989 | Van Nort | 198/335 |
| 5,029,690 | A | * | 7/1991 | Nguyen et al. | 198/335 |
| 5,295,568 | A | * | 3/1994 | Saito et al. | 198/330 |
| 5,628,391 | A | * | 5/1997 | Volkening et al. | 198/325 |
| 6,129,198 | A | * | 10/2000 | Nusime | 198/326 |
| 6,523,666 | B2 | * | 2/2003 | Winkler | 198/321 |
| 6,685,002 | B1 | * | 2/2004 | Nurnberg et al. | 198/321 |
| 8,276,737 | B2 | * | 10/2012 | Lanzki et al. | 198/326 |

FOREIGN PATENT DOCUMENTS

| | | | |
|---|---|---|---|
| EP | 0 866 019 | A1 | 9/1998 |
| JP | 7 228462 | A | 8/1995 |

* cited by examiner

*Primary Examiner* — Douglas Hess
(74) *Attorney, Agent, or Firm* — Ladas & Parry LLP

(57) ABSTRACT

An escalator or a moving walkway includes a support structure and a soffit plate. A first side edge region of the soffit plate is fixedly connected with the support structure. In addition, the soffit plate is biased between the first side edge region and a second side edge region, which is opposite the first side edge region, by a predetermined biasing force. In order to maintain the bias the second side edge region is fixedly connected with the support structure, wherein through the maintenance of the biasing force a stiffness of the support structure is increased and in operation of the escalator or the moving walkway the output of noise is reduced.

19 Claims, 5 Drawing Sheets

ESCALATOR OR MOVING WALKWAY WITH A SOFFIT PLATE

CROSS-REFERENCE TO RELATED APPLICATION

This application claims priority to European Patent Application No. 11179240.4, filed Aug. 30, 2011, which is incorporated herein by reference.

FIELD

The disclosure relates generally to an escalator or a moving walkway with a soffit plate.

BACKGROUND

Escalators or moving walkways have a support structure. This support structure is usually a framework construction which is produced at the manufacturer as a whole unit or subdivided into support structure modules. The support structure or the support structure modules or framework modules thereof are installed in a building, wherein the support structure, for example, connects two levels of the building. The movable components of the escalator or moving walkway are arranged in this support structure, for example a step belt or a plate belt, deflecting axles, a drive shaft and the drive motor with transmission, the control thereof, monitoring systems, safety systems and more of the same. In addition, stationary components such as, for example, balustrades, comb plates, bearing points, guide tracks and guide rails are also fixedly connected with the support structure.

SUMMARY

In at least some embodiments of an escalator or a moving walkway, the support structure with a soffit plate is producible more economically and the sound-damping characteristics are the same as or better than those of a conventionally produced support structure of the same dimensions.

In some embodiments, an escalator or moving walkway comprises a support structure and a soffit plate bounded in its area extent by side edge regions. A first side edge region of the soffit plate is fixedly connected with the support structure.

The soffit plate is, in addition, biased between the first side edge region and a second side edge region, which is opposite the first side edge region, by a predetermined biasing force value. In order to maintain the bias the second side edge region is also fixedly connected with the support structure. Through maintenance of the biasing force the stiffness of the support structure is increased and in operation of the escalator or the moving walkway the output of noise is reduced.

As "fixedly connected" there is to be understood in the sense of the present disclosure all connections suitable for almost completely maintaining the bias of the soffit plate over time. Accordingly, no continuing displacement of the side edge region relative to the support structure takes place within the fixed connection under bias and at room temperature. In the loaded cross-section of the bottom chords of the support structure the bias causes a compression loading of the material and in the cross-section of the soffit plate a tension loading of the material, which is below the elastic limit. Through the biasing of the soffit plate a stiffness of the support structure is additionally achieved which goes beyond the stiffness of a conventionally produced support structure provided with a soffit plate.

The first and second side edge regions of the soffit plate can be fixedly connected with the support structure by frictional connection, metallic continuity or form fitting connection. Weld connections and solder connections are suitable as fixed connections by metallic continuity. Clamping strips and screw connections are suitable as fixed connections by frictional connection. Rivets, penetration joints, clinch connections as well as screw connections combined with pin connections are suitable as fixed connections by form fitting connection.

Pure gluing (without form fitting or frictional connecting additional means) of the first and second side edge regions to the support structure is, in at least some embodiments, not suitable as a fixed connection. Since polymer materials flow or creep under load, the biasing force of the soffit plate in the case of a pure gluing could very rapidly diminish. This loss of biasing force can lead to a reduction in the stiffness in the length direction of the support structure and in the torsional stiffness of the support structure and, accompanying that, to optically perceptible distortions (waves and valleys) of the soffit plate. In addition, an unstressed soffit plate begins to vibrate at lower frequencies than a biased soffit plate. Just the typical mode of operation of moving walkways and escalators at low speeds of the step belt or plate belt causes a vibration spectrum with low frequencies, for example of 4 Hertz to 15 Hertz. This vibration spectrum can lie in the region of the resonance frequency of an unstressed soffit plate and thereby lead to an unpleasant output of noise in operation.

Since only two side edge regions of the soffit plate are fixedly connected with the support structure, production cost can be substantially reduced by comparison with a weld seam encircling the soffit plate. For example, in the case of a soffit plate which is bounded by four side edge regions the first side edge region and the second side edge region are fixedly connected with the support structure, whilst the third side edge region and the fourth side edge region are not fixedly connected with the support structure.

A vibration-damping intermediate layer can be arranged between at least one side edge region of the soffit plate and the support structure at least in a section. The vibration-damping intermediate layer, which is arranged at least in a section, in the side edge regions of the biased soffit plate prevents output of noise due to vibrations in the low and medium frequency range. Vibrations with medium frequencies can, in the case of the absence of a vibration-damping intermediate layer, lead to transient local lifting of the remaining side wall regions, which are not fixedly connected, off the support structure and generate noises in the case of impact on a bottom chord of the support structure.

The support structure can be subdivided into support structure modules, wherein each of these support structure modules has a soffit plate. The first side edge region thereof and the second side edge region thereof, which is opposite the first side edge region, are fixedly connected with the support structure. The soffit plate of each support structure module is biased between the first side edge region and the second side edge region.

A vibration-damping intermediate layer can be arranged, just as in the case of an integral support structure, also in the case of the individual support structure modules between the remaining side edge regions and the support structure module at least in a section.

If the support structure or support structure module has two side parts which are connected together by transverse struts the vibration-damping intermediate layer can be arranged at bottom chords of the side parts and at the transverse struts connecting the bottom chords. The transverse struts can be, for example, transverse girders, transverse bridges, transverse slabs, transverse brackets, transverse sections and more of the same.

The vibration-damping intermediate layer can be, for example, a polymer material strip or polymer material adhesive strip. In addition, an adhesive applied at least in a section can be used as vibration-damping intermediate layer. Insofar as the adhesive is an oil-resistant adhesive sealant which is applied to encircle the entire side edge region, an oil-tight or liquid-tight and dust-tight trough can be formed by the soffit plate and by parts of the support structure or support structure module. Particularly suitable are pasty or liquid single-component adhesives/sealants on the basis of silane-modified polymers which cross-link by air humidity to form a resilient product. These are used, for example, in bodywork and vehicle construction, carriage construction and container construction as well as in metal and apparatus construction.

The bottom chords of the support structure are loaded, in the operating position of the escalator or the moving walkway, by tension forces, whereas the upper belts retain compression forces. Through the biasing of the soffit plate the bottom belts are relieved, since the biasing force produces compression forces in the bottom chords. To a small extent the top chords are also relieved of load, since the clamping produces tension forces in the top chords. The cross-section of the soffit plate can be appropriately dimensioned in the case of given permissible elastic limits of the material so that this is able to retain not only the biasing force, but also a part of the useful load, which is to be borne by the support structure, and the tension force, which is caused by the intrinsic mass, in the bottom chord of the support structure. In order to be able to use soffit plates which are as thin as possible and thereby light, the material of the support structure possibly differs from the material of the soffit plate in its material properties, wherein the soffit plate possibly has a higher elastic limit that the material of the support structure. This enables use of soffit plates with thicknesses of 0.5 millimeters to 2.5 millimeters. The soffit plate possibly has a thickness of 0.8 millimeters to 1.0 millimeter. Tests have shown that soffit plates of this thickness can be clamped without problems even over obtusely angled corners of the support structure or support structure module.

At least two soffit plates can be arranged over the length direction of the support structure or support structure module. A butt joint is then present between two soffit plates. In order that the soffit plates can be fixedly connected in the region of the butt joint with the support structure or support structure module or the butt joint can be sealed the butt joint is preferably arranged in the region of a transverse strut.

The soffit plate is possibly biased in the length direction of the support structure or support structure module. This can mean that the bottom chords and upper chords of the support structure can be relieved of load as described further above.

In order that parts of the support structure are not deformed by the biasing force of the soffit plate the support structure or support structure module can be provided with reinforcing means for retaining the bias. Such reinforcing means can be reinforcing ribs, reinforcing plates, reinforcing sections or reinforcing struts, which are fixedly connected with the support structure or support structure module and remain thereat. In particular, however, support structure modules can also have temporary reinforcing means which are connected with the support structure module only during the production process and can be removed after the assembly of the support structure.

The soffit plates can have any desired shape in the area extent thereof. In addition, the first side edge region and the second side edge region do not have to be arranged parallel to one another. For production engineering reasons the soffit plate is, however, possibly formed to be square or rectangular.

In at least some cases, the method for covering a support structure or support structure module of an escalator or moving walkway with a soffit plate bounded by side edge regions is extremely economic, can be realized in simple manner and contains only a few method steps.

In some embodiments, method comprises acts to the effect that

- a first side edge region of the soffit plate is fixedly connected with the support structure or the support structure module,
- a second side edge region opposite the first side edge region of the soffit plate is clamped in a clamping device which is supported relative to the support structure or support structure module,
- the soffit plate is clamped by means of the clamping device and
- the second side edge region of the biased soffit plate is fixedly connected with the support structure or support structure module.

A vibration-damping intermediate layer can be arranged between the soffit plate and the support structure or support structure module at least in a section. This can be arranged prior to the connection of the first side edge region with the support structure or support structure module. The vibration-damping intermediate layer can also be arranged after the connection of the first side edge region with the support structure or support structure module.

In order to be able to more conveniently cover the support structure, the support structure or support structure module is usually brought into a production position so that the surface to be covered is directed upwardly. In the operating position the surface covered by the soffit plate is directed downwardly.

The biasing of the soffit plate can be carried out by a clamping device which comprises at least one hydraulic unit, a compressed air connection, and at least one hydraulic cylinder or pneumatic cylinder. The biasing force can be readily set and controlled by the oil pressure in the hydraulic cylinder or gas pressure in the pneumatic cylinder.

Moreover, the biasing can also be carried out by a clamping device having at least one threaded spindle. A combination of threaded spindle and hydraulic cylinder or pneumatic cylinder is also possible, wherein the pneumatic or hydraulic cylinder is used for applying the clamping force and the threaded spindle serves for securing the clamped state until the second side edge region is fixedly connected with the support structure. The clamping device can be subsequently removed.

In tests at support structures it was able to be ascertained that soffit plates of the aforesaid thickness of 0.5 millimeters to 2.5 millimeters and with a width of 1.5 meters can be biased by a biasing force from 10 kN to 140 kN. Corresponding tests were also performed on support structures with widths of 0.9 meters, 1.1 meters, 1.3 meters, 1.7 meters, 1.9 meters and 2.1 meters. Some results were achieved with soffit plates of stainless steel, for example 1.4301 (X5CrNi18-10), which has been biased at 1.5 meters width and 0.8 millimeters thickness between 35 kN to 55 kN.

BRIEF DESCRIPTION OF THE DRAWINGS

The support structure of an escalator or a moving walkway with at least one soffit plate is explained in more detail in the following by way of examples and with references to the drawings, in which.

DETAILED DESCRIPTION

Figure 1:
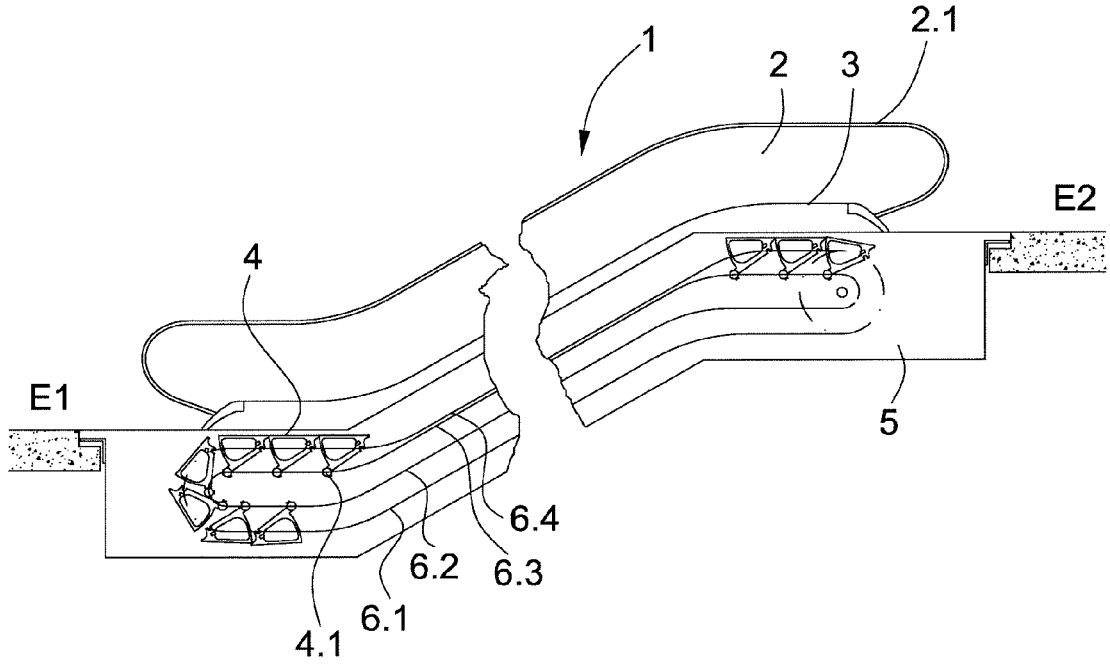
FIG. 1 shows, in schematic illustration, an escalator with support structure, in which guide rails and a circulating step belt are arranged.

FIG. 1 shows an escalator 1 with a balustrade 2 carrying a handrail 2.1. In addition, the escalator 1 comprises a support structure 5 which carries the balustrades 2. The balustrades 2 have base plates 3, between which laterally guided steps 4 are arranged to circulate. The escalator 1 connects a first floor E1 with a second floor E2. Guide rollers 4.1 of the steps 4 travel on guide rails 6.3, 6.4 or on guide tracks 6.1, 6.2, which are connected with the support structure 5 of the escalator 1 by means of, for example, a screw connection, weld connection, press connection, rivet connection or penetration joining (clinching). Although FIG. 1 shows an escalator 1 with steps, further embodiments are also suitable for a moving walkway with a plate belt.

Figure 2:
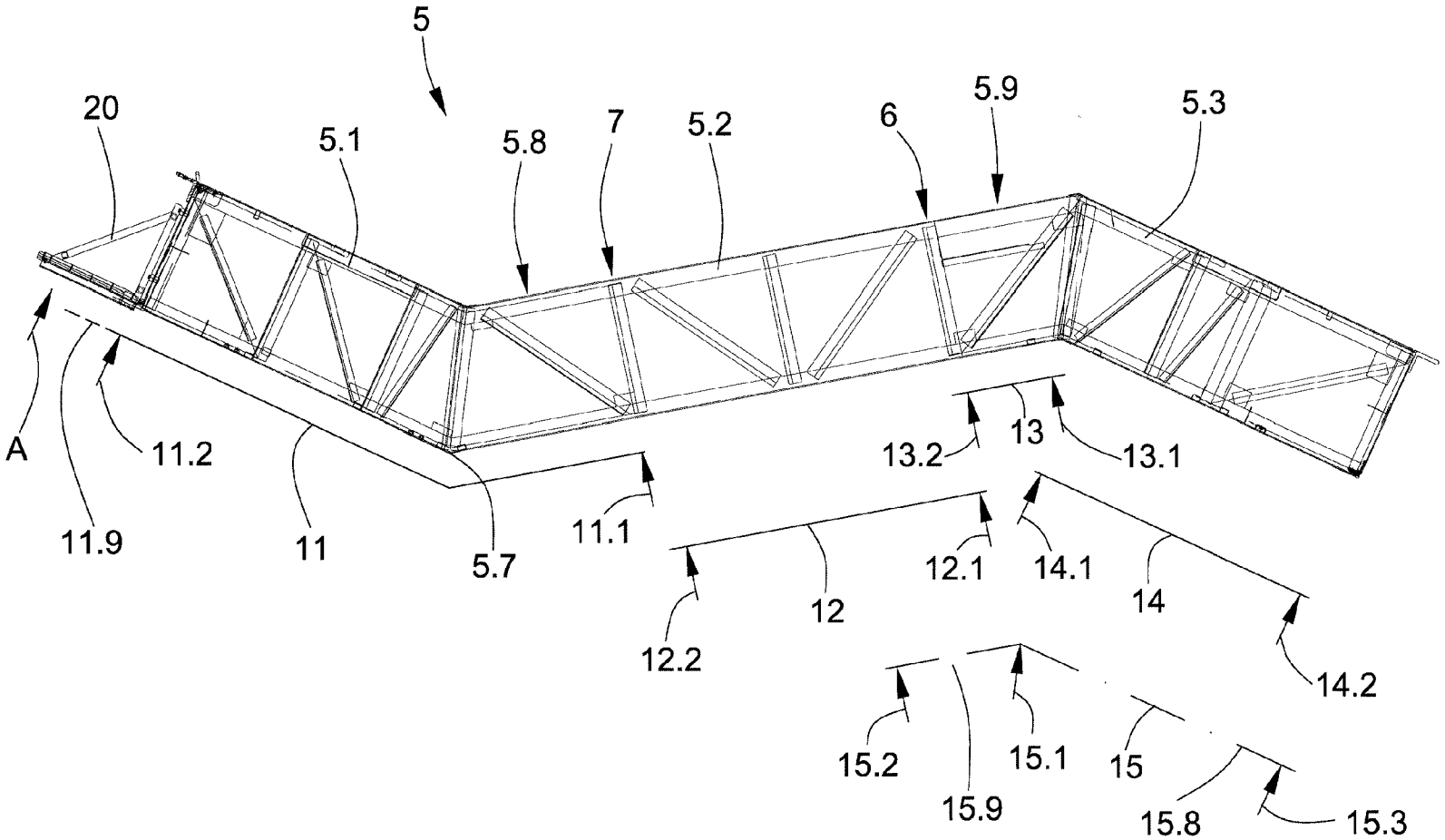
FIG. 2 shows the support structure of FIG. 1 in side view with a clamping device and with a plurality of soffit plates.

FIG. 2 shows the support structure 5 of FIG. 1 in side view with a clamping device 20 and with a plurality of soffit plates 11, 12, 13, 14, 15. The support structure 5 is sub-divided into a first support structure module 5.1, a second support structure module 5.2 and a third support structure module 5.3. This sub-division can be advantageous in the case of support structures 5 of escalators and moving walkways spanning substantial distances, since these can be more easily transported from the manufacturer's works to the place of installation. In addition, confined installation conditions in existing buildings can oblige a sub-division. The support structure 5 can also be constructed integrally or in one piece and provided only with one soffit plate continuously or in sections with several soffit plates. The illustrated division of the support structure 5 into a plurality of support structure modules 5.1, 5.2, 5.3 is only by way of example; the separation points 6, 7 can also be arranged at other places of the support structure 5. Each of these support structure modules 5.1, 5.2, 5.3 is provided with a soffit plate 11, 12, 13, 14, 15 or, due to the plate thickness of the soffit plates 11, 12, 13, 14, 15 and the bias, covered to a certain extent by this.

The soffit plates 11, 12, 13, 14, 15 are illustrated lifted up from the support structure modules 5.1, 5.2, 5.3 in order to show the division thereof. The places denoted by arrows refer to the respective first side edge region 11.1, 12.1, 13.1, 14.1, 15.1 and the second side region 11.2, 12.2, 13.2, 14.2, 15.2, 15.3 of the soffit plates 11, 12, 13, 14, 15, which are fixedly connected with the associated support structure modules 5.1, 5.2, 5.3.

The first support structure module 5.1 has an angled first region 5.8 with which the second support structure module 5.2 is connected. By virtue of the angled first region 5.8 the soffit plate 11 is clamped over an edge 5.7. Tests have shown that this is possible without problems. Moreover, also arranged at the first support structure module 5.1 is a clamping device 20 which after the fixed connection of the second side edge region 11.2 with the first support structure module 5.1, for example by spot welding or longitudinal welding, is removed. A plate projection 11.9, which is indicated by a dashed lined, of the soffit plate 11 is in a given case also removed or severed. This plate projection 11.9 can be necessary, depending on the respective design of the clamping device 20, in order to connect the second side edge region 11.2 with the clamping device 20. The construction and the function of the clamping device 20 are described in conjunction with FIG. 6, which shows the view A of the clamping device 20.

The third support structure module 5.3 has, like the first support structure module 5.1, an angled second region 5.9. Since, however, this second region 5.9 extends to be complementary with the first region 5.8 and thereby has an obtusely angled corner, the third support structure 5.3 is possibly provided with two soffit plates 13, 14.

As an alternative to the two soffit plates 13, 14, also only one soffit plate 15 can be arranged as is indicated by dot-dashed lines. Before this soffit plate 15 is connected with the third support structure module 5.3 it can be pre-shaped or folded in correspondence with the surface, which is to be covered, of the support structure 5.3 and the obtusely angled corner thereof, wherein the thereby-created fold point of the soffit plate 15 is divided into two limbs 15.8, 15.9. The fold location serves as a first side edge region 15.1 for the two limbs 15.8, 15.9 of the soffit plate 15, since this is firstly fixedly connected with the support structure 5.3. Each of the two limbs 15.8, 15.9 has a second side edge region 15.2, 15.3. These can be connected with a clamping device 20, for application of the biasing force, simultaneously or in succession. If one of the two limbs 15.8, 15.9 is very short, in a given case it is also possible to dispense with biasing of this short limb.

Figure 3:
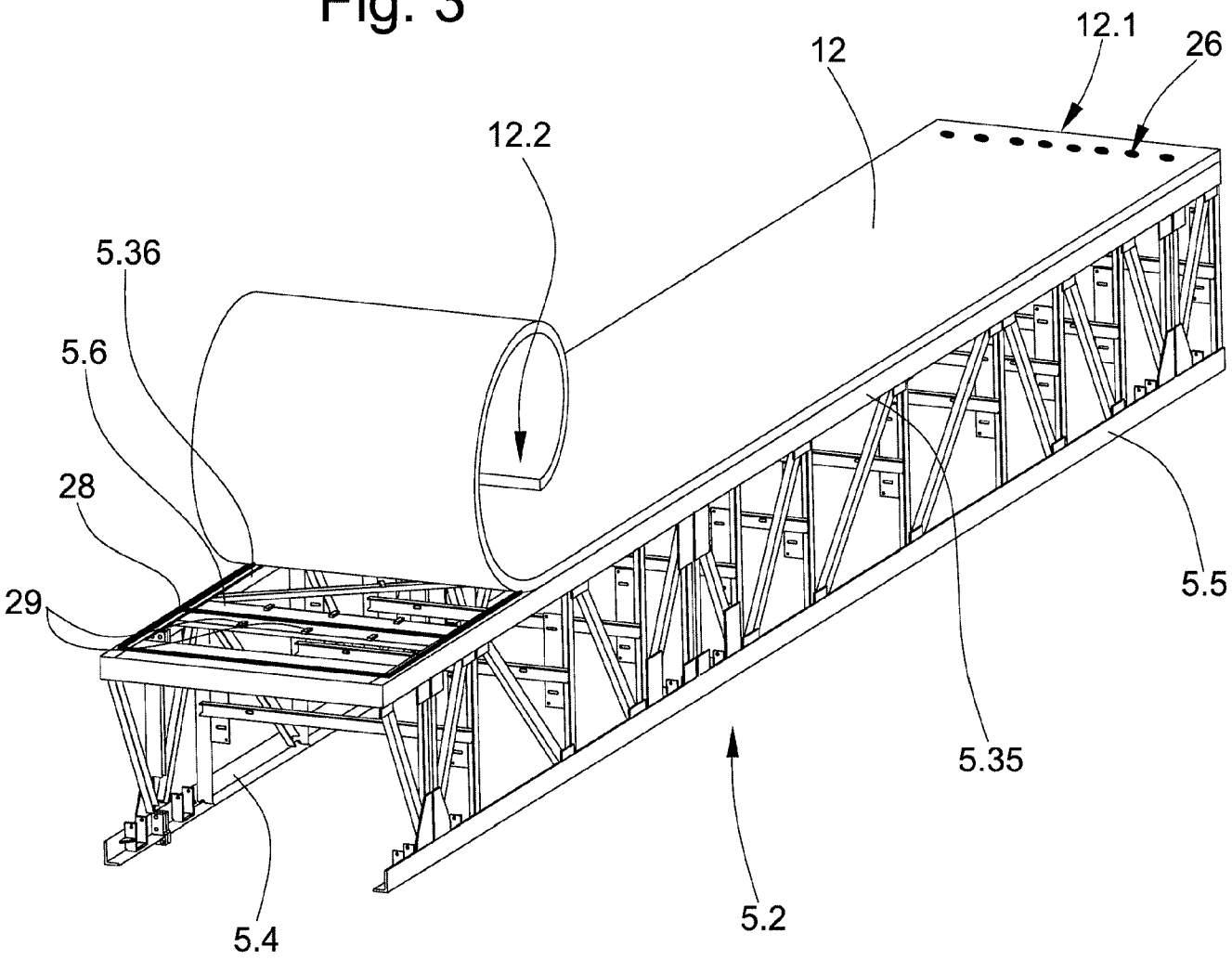
FIG. 3 shows, in three-dimensional view, a support structure module with a soffit plate, the first side edge region of which is fixedly connected with the support structure module by material coupled through spot-welding and the second side edge region of which is illustrated partly rolled up in order to show the vibration-damping intermediate layer arranged on the support structure module.

FIG. 3 shows in three-dimensional view the second support structure module 5.2 of FIG. 2 with the soffit plate 12, the first side edge region 12.1 of which is fixedly connected with the support structure module 5.2 in metallic continuity by means of spot-welding 26. The support structure 5.2 has two framework-shaped side parts 5.4, 5.5 which are connected together by transverse struts 5.6. The support structure module 5.2 is illustrated in its production position, for which reason the soffit plate 12 lies at the top on the support structure module 5.2. The second side edge region 12.2 of the soffit plate 12 is partly rolled up only for the purposes of illustration so as to show the vibration-damping intermediate layer 28 arranged between the support structure module 5.2 and the soffit plate 12.

This can be, for example, an adhesive/sealant on the basis of silane-modified polymers, which adhesive/sealant is, as illustrated, applied continuously to the bottom chords 5.35, 5.36 of the side parts 5.4, 5.5 and the transverse struts 5.6 before the soffit plate 12 is placed on the support structure module 5.2 and the two side edge regions 12.1, 12.2 are fixedly connected with the support structure module 5.2. In that case the places of the support structure module 5.2 at which the first and second side edge regions 12.1, 12.2 are welded should be as free as possible of adhesive/sealant or non-weldable parts.

These adhesives should usually have a specific layer thickness in order to create the vibration-damping property. In order to achieve a specific layer thickness, spacers 29 can in addition be arranged between the soffit plate 12 and the support structure module 5.2. These possibly consist of a polymer material, which similarly has vibration-damping properties.

A double-sided adhesive strip of polymer material, for example an elastomeric strip, can also be used as vibration-damping intermediate layer 28 instead of the adhesive/sealant, wherein in the case of sufficient pressure resistance of this elastomeric strip no spacers 29 are needed.

The arrangement of the vibration-damping intermediate layer 28 is shown at the second support structure module 5.2 only by way of example. The first and third support structure modules 5.1, 5.3 illustrated in FIG. 2 or an integral or one-piece support structure 5 can obviously also be provided in the same way with a vibration-damping intermediate layer 28.

Figure 4:
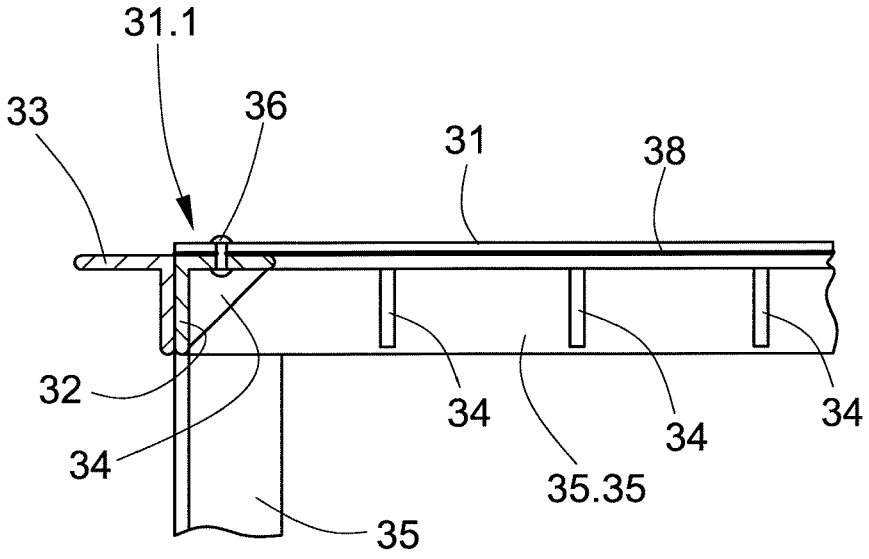
FIG. 4 shows, in sectional side view, a second embodiment of a fixed connection of the first side edge region with the support structure by riveting.

As already mentioned further above, a soffit plate can be fixedly connected with the support structure by different connecting means. Instead of the spot-welding mentioned in FIG. 3, FIG. 4 shows in sectional side view a second embodiment of a fixed connection. The first side edge region 31.1 of the soffit plate 31 is connected with the support structure 31 by means of a row of rivets 36. Gun nails, blind rivets or tension-shear rivets can also be used instead of the rivets 36. If the second side edge region (not illustrated) is also to be connected with the support structure 35 by means of rivets 36 it can be ensured that the shank diameter of the rivets 36 fits as free of play as possible with the bores into which they are inserted, since otherwise after removal of the clamping device only a small or no biasing force remains. In a given case the rivets 36 can also be supplemented by fit pins so that the form fitting connection in the direction of the biasing force is effected by the fit pins and the form fitting connection orthogonally to the biasing force by the rivets 36. Screws, possibly fit screws, can also be used in place of the rivets 36. Also able to be readily seen is the vibration-damping intermediate layer 38 arranged between the soffit plate 31 and the support structure 35.

The biasing of the soffit plate 31 is supported by the chords 35.35 and the transverse struts 32 of the support structure 35. As indicated in FIG. 4 by ribs 34 and a reinforcing bracket 33, it can be necessary to reinforce the chords 35.35 and the transverse struts 32 of the support structure 35 at places. Use can be made as reinforcing means not only of ribs 34 and reinforcing brackets 33, but also struts, supports and the like. Individual components such as, for example, a transverse strut 32 retaining tension forces and/or bending moments can also be dimensioned to be larger. Depending on the respective design of the transverse strut 32 the reinforcing bracket 33 can be removed if the covering of the support structure 35 is effected by soffit plate 31. The reinforcing bracket 33 serving only as temporary reinforcing means can, however, also be part of a clamping device (not illustrated).

Figure 5:
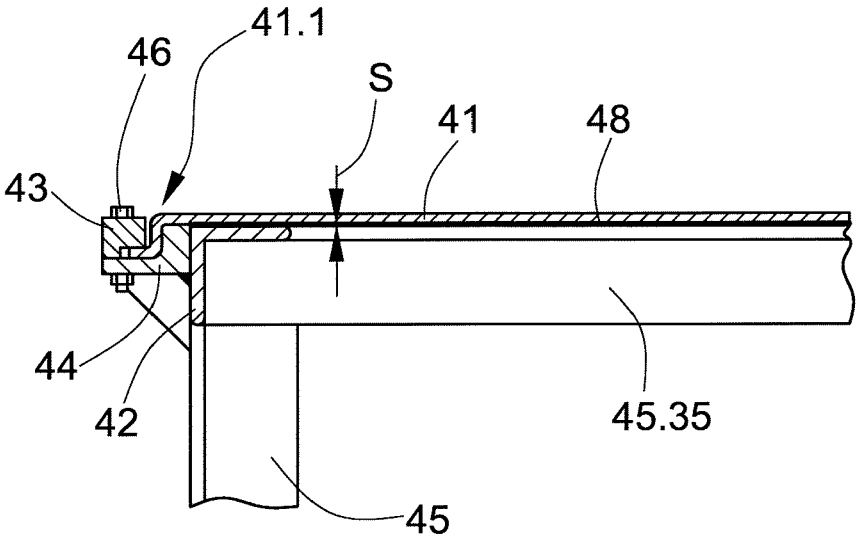
FIG. 5 shows, in sectional side view, a third embodiment of a fixed connection of the first side edge region with the support structure by means of a clamping strip.

A third embodiment of a fixed connection is illustrated in FIG. 5 in sectional side view. The first side edge region 41.1 of the soffit plate 41 is fixedly connected with the support structure 45 by means of a clamping strip 43. The clamping strip 43 is firmly screw-connected with a base 44 by means of screw 46. The first side region 41.1 is clamped in place between the base and the clamping strip and forms a fixed connection by frictional forces. In addition, the first side region 41.1 has a double cranking. Through a combination of the fixed connection by frictional forces by means of clamping strip 43 with a mechanically positive couple by means of the cranking a higher biasing force on the support structure 45 can be supported than would be possible by the clamping force of the clamping strip 43 alone.

The base 44 is fixedly connected with the support structure 45 by means of, for example, weld seams and additionally serves, through the vertical offset S, as a spacer so that the vibration-damping intermediate layer 48 has a predetermined layer thickness. The vibration-damping intermediate layer 48 is arranged between the soffit plate 41 and the lower chord 45.35 as well as the transverse strut 42 of the support structure 45, but not between the base 44 and the soffit plate 41.

Figure 6:
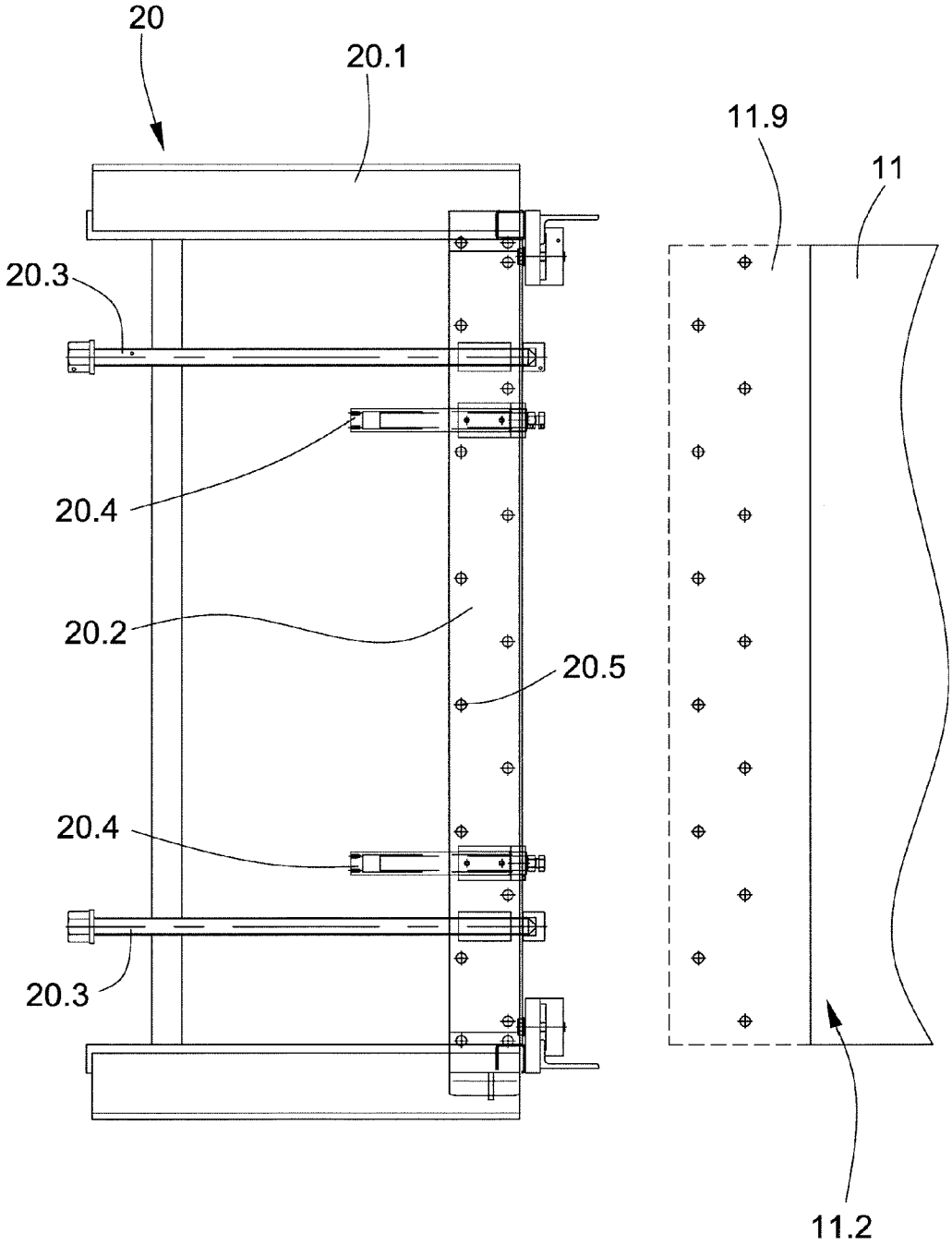
FIG. 6 shows the view A of the clamping device of FIG. 2.

FIG. 6 shows the view A of the clamping device 20 of FIG. 2. In addition, the soffit plate 11, which is to be clamped, with the plate projection 11.9 is illustrated. The clamping device 20 comprises a base frame 20.1 at which a clamping beam 20.2 is linearly guided. Two hydraulic cylinders 20.4 and two threaded spindles 20.3 are arranged between the clamping beam 20.2 and the base frame 20.1. The clamping beam 20.2 has threaded bores 20.5 at which the plate projection 11.9 is fastened by means of screws. The base frame 20.1 is detachably connected with the support structure (not illustrated). The hydraulic cylinders 20.4 are supplied by a hydraulic unit (not illustrated).

As soon as the first side edge region (not illustrated) of the soffit plate 11 is fixedly connected with the support structure the base frame 20.1 is mounted on the support structure and the plate projection 11.9 of the second side edge region 11.2 is connected with the clamping beam 20.2, the soffit plate 11 can be biased by displacing the clamping beam 20.2 relative to the base frame 20.1. The application of the bias is carried out by means of the hydraulic cylinders 20.4, wherein the clamping force can be read off with the help of, for example, manometers. As soon as the predetermined biasing force is reached, the clamping spindles 20.3 are adjusted in order to secure the clamping beam 20.2 in its position relative to the base frame 20.1. The second side edge region 11.2 is subsequently fixedly connected with the support structure by, for example, spot-welding or a longitudinal weld. The threaded spindles 20.3 can now be released, the hydraulic cylinders 20.4 relieved of pressure and the plate projection 11.9 separated from the clamping beam 20.2. After removal of the clamping device 20 the plate projection 11.9 can be severed from the soffit plate 11 and discarded.

Although the disclosed technologies have been described through the illustration of specific exemplifying embodiments it is obvious that numerous further variants of embodiment can be created, for example through the features of the individual embodiments being combined with one another and/or individual functional units of the embodiments exchanged. For example, the first side edge region of a soffit plate can be riveted to the support structure and the second side edge region welded.

Moreover, only soffit plates are mentioned in the entire description, wherein the feature "plate" is usually used for plates of metallic materials. However, it is obvious that all kinds of plates can be used as soffit plates insofar these can retain the biasing force. Such plates can be, for example, plates of fiber-reinforced polymer materials, composite plates, coated plates and metal sheets, polymer material plates with embedded metallic tensile carriers and the like. Consequently, correspondingly designed support structures with the aforesaid plates come within the scope of protection of the present claims.

Having illustrated and described the principles of the disclosed technologies, it will be apparent to those skilled in the art that the disclosed embodiments can be modified in arrangement and detail without departing from such principles. In view of the many possible embodiments to which the principles of the disclosed technologies can be applied, it should be recognized that the illustrated embodiments are only examples of the technologies and should not be taken as limiting the scope of the invention. Rather, the scope of the invention is defined by the following claims and their equivalents. We therefore claim as our invention all that comes within the scope and spirit of these claims.

We claim:

1. An escalator or moving walkway, comprising:

a support structure; and a soffit plate, the soffit plate being bounded by a plurality of soffit plate side edge regions, the plurality of side edge regions comprising opposing first and second side edge regions, the first and second side edge regions being fixedly connected to the support structure, the soffit plate being biased between the first and second side edge regions by a biasing tensioning force and increasing a stiffness of the support structure.

2. The escalator or moving walkway of claim 1, the plurality of side edge regions further comprising third and fourth side edge regions, the third and fourth side edge regions being not fixedly connected to the support structure.

3. The escalator or moving walkway of claim 1, the support structure comprising first and second support structure modules, the soffit plate being a first soffit plate, the first and second side edge regions of the first soffit plate being fixedly connected to the first support structure module, the biasing force being a first biasing force, the escalator or moving walkway further comprising a second soffit plate, first and second side edge regions of the second soffit plate being fixedly connected to the second support structure module, the second soffit plate being biased between the first and second edge regions of the second soffit plate by a second biasing force.

4. The escalator or moving walkway of claim 3, further comprising a butt joint between the first and second soffit plates, the butt joint being arranged in a region of a transverse strut.

5. The escalator or moving walkway of claim 3, the first soffit plate being biased in a length direction of the support structure or of the support structure module.

6. The escalator or moving walkway of claim 3, the support structure or the support structure module further comprising a reinforcing element.

7. The escalator or moving walkway of claim 1, a vibration-damping layer being arranged between the first or second side edge region and the support structure.

8. The escalator or moving walkway of claim 7, the support structure comprising first and second side parts, the first and second side parts being connected by transverse struts, the vibration-damping layer being arranged at bottom chords of the first and second side parts and at the transverse struts.

9. The escalator or moving walkway of claim 7, the vibration-damping layer comprising a polymer material strip.

10. The escalator or moving walkway of claim 7, the vibration-damping layer comprising an oil-resistant adhesive or sealant applied around the plurality of side edge regions.

11. The escalator or moving walkway of claim 1, the soffit plate having a thickness of 0.5 millimeters to 2.5 millimeters.

12. The escalator or moving walkway of claim 1, the soffit plate having a thickness of 0.8 millimeters to 1.0 millimeters.

13. The escalator or moving walkway of claim 1, the soffit plate having a square form.

14. The escalator or moving walkway of claim 1, the soffit plate having a rectangular form.

15. A method comprising:

fixedly connecting a first side edge region of a soffit plate to a support structure for an escalator or for a moving walkway;

clamping a second side edge region of the soffit plate to the support structure, the clamping biasing the soffit plate with a predetermined tension biasing force; and fixedly connecting the second side edge region to the support structure.

16. The method of claim 15, further comprising arranging a vibration-damping layer between the soffit plate and the support structure.

17. The method of claim 15, the clamping device comprising: at least one of a threaded spindle and a hydraulic unit; and a hydraulic cylinder or a pneumatic cylinder.

18. The method of claim 15, the predetermined biasing force being 10 kN to 140 kN.

19. The method of claim 15, the predetermined biasing force being 35 kN to 55 kN.

* * * * *